US006521570B2

(12) United States Patent
Ostyn et al.

(10) Patent No.: US 6,521,570 B2
(45) **Date of Patent: *Feb. 18, 2003**

(54) AUTOMOTIVE LUBRICANT

(75) Inventors: Marcel Alphonse Ostyn, Boise-Guillaume (FR); Dominique Alves, Mont Saint Aignan (FR); Alain Gabriel Bouffet, Bois-Guillaume (FR); Edgar Andreas Steigerwald, Hamburg (DE)

(73) Assignee: ExxonMobil Research and Engineering Company, Annandale, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/284,457

(22) PCT Filed: Feb. 1, 1993

(86) PCT No.: PCT/EP93/00231

§ 371 (c)(1),
(2), (4) Date: Jan. 26, 2000

(87) PCT Pub. No.: WO93/16151

PCT Pub. Date: Aug. 19, 1993

(65) Prior Publication Data

US 2003/0008783 A1 Jan. 9, 2003

(30) Foreign Application Priority Data

Feb. 7, 1992 (FR) ..... 92 01411

(51) Int. Cl.[7] ..... C10M 169/04

(52) U.S. Cl. ..... 508/272; 508/273; 508/332; 508/333; 508/353; 508/371; 508/563; 508/584

(58) Field of Search ..... 508/272, 273, 508/332, 333, 353, 371, 563, 584

(56) References Cited

U.S. PATENT DOCUMENTS

| | | | | |
|---|---|---|---|---|
| 2,892,784 A | | 6/1959 | Harle et al. | |
| 4,707,284 A | * | 11/1987 | Goldblatt et al. | 508/273 |
| 4,801,391 A | * | 1/1989 | Goldblatt et al. | 508/273 |
| 5,019,662 A | * | 5/1991 | Vora et al. | 585/323 |
| 5,064,546 A | | 11/1991 | Dasai | 252/32.5 |

FOREIGN PATENT DOCUMENTS

| | | | |
|---|---|---|---|
| EP | 02 40813 | 10/1987 | C10M/111/04 |
| EP | 02 81992 | 9/1988 | C10M/101/00 |

* cited by examiner

*Primary Examiner*—Jacqueline V. Howard
(74) *Attorney, Agent, or Firm*—Norby L. Foss

(57) ABSTRACT

An automotive lubricant comprising a white oil basestock and one or more additives, at least one additive being an antioxidant. The white oil basestock may be blended with mineral oil and/or synthetic oil basestocks. The lubricant can be used, for example, as an engine oil, gear oil or automatic transmission fluid.

8 Claims, 1 Drawing Sheet

AUTOMOTIVE LUBRICANT

The present invention relates to automotive lubricants such as engine oils, gear oils and automatic transmission fluids.

Traditionally automotive lubricants have been based on conventional mineral oils. Whilst these have proved adequate in the past, mineral oil basestocks cannot always meet the increasing demands for superior lubricant properties, especially operational lifetime. These improved properties can be obtained to some extent by the use of additives, but research has also been conducted into modifying or changing the basestocks. In recent years lubricant manufacturers have produced automotive lubricants based on synthetic basestocks, for example polyalphaolefins and esters. Whilst these provide improved performance, they have the disadvantage that they are expensive.

There is therefore a need for an automotive lubricant with an alternative, less expensive basestock which provides improved properties.

UK Patent 737,392 discloses a lubricating oil containing an organo-tin compound as antioxidant. The basestock may be derived from petroleum distillates and residuals refined by conventional. means, hydrogenated mineral oils, white mineral oils, or polyether and polyester lubricants used alone or blended with mineral oil lubricants. The lubricant may be applied as a crank case oil, heating oil, hydraulic fluid, cutting oil, turbine oil or transformer oil.

U.S. Pat. No. 3,853,773 discloses an anti-gum and solvating lubricant for use with precision mechanical devices. It is based on a combination of a type-A transmission fluid (as defined in. the patent) with a highly refined white oil.

U.S. Pat. No. 4,652,385 discloses a lubricant containing a combination of a tri-substituted phosphite and sterically hindered phenolic stabilisers as antioxidant.. The basestock is a hydrotreated oil, polyalphaolefin oil or paraffinic white oil, or mixtures thereof. The lubricant is used in high temperature applications, for example as a compressor oil, heat transfer oil, hydraulic fluid or steam turbine oil.

The present invention provides an automotive lubricant comprising:

(a) a basestock of which at least 30 wt. % is a white oil; and (b) an antioxidant selected from one or more of zinc dialkyldithiophosphate, zinc diaryldithiophosphate, zinc alkylaryldithiophosphate, alkylated diphenylamine, hindered phenol, phosphosulphurised alkylphenol, sulphurised phenol, dimercaptodithiadiazole and copper-based antioxidant compounds;

with the proviso that the lubricant does not contain a tin-containing antioxidant or an organically substituted phosphite or diphosphite antioxidant.

The white oil based automotive lubricant according to the invention has the advantage that it possesses superior oxidation stability properties compared with automotive lubricants based on mineral oils, but has a lower production cost compared with lubricants based on synthetic oils. Thus the lubricant has the benefit of increased operation times, i.e. it can be used to lubricate a mechanical device, for example an engine or gear box for an extended period before it requires draining and replacing. In some applications the lubricant can be used as a fill-for-life lubricant, i.e. the operational life-time of the lubricant matches or exceeds that of the mechanical part it is lubricating. White oils are defined in the "Food and Drug Administration Code of Federal Regulation", 1991. Either medical white oils according to specification FDA 21 CFR 178-3620 (a) or technical white oils according to specification FDA CFR 178-3620 (b) may be employed in the invention.

The white oil is a conventional white oil, obtained using conventional solvent extraction and hydrogenation to produce saturated hydrocarbons free from sulphur and nitrogen. It has been found that white oils with a relatively high naphthenic content exhibit improved properties compared with more paraffinic white oils. Preferably the white oil, used in the present invention naphthenic content of at least 25 wt. %, where 'naphthenic content' is defined as the amount of naphthenic carbon as a percentage of the total carbon content of the white oil, according to standard test ASTM D 2140. More preferably the naphthenic content of the white oil is from 30 to 50 wt. %, most preferably 30 to 40 wt. %. A highly naphthenic white oil is obtained by using mild hydrogenation conditions, so that the cyclic molecules contained in the oil are not substantially broken. Typical mild hydrogenation conditions are a temperature of between 150 and 250° C., and a pressure 1000 and 20,000 kPa.

The naphthenic composition of the highly naphthenic white oils advantageously used in the present invention is preferably as follows, the measurements being obtained using standard test method ASTM D 2786:

1 ring: 20–30 wt. %, preferably 24–32 wt. %

2 rings: 13–27 wt. %, preferably 17–23 wt. %

3 rings: 4–21 wt. %, preferably 8–17 wt. %

4 rings: 3–19 wt. %, preferably 7–15 wt. %

5 rings or more: 0–9 wt. %, preferably 2–5 wt. %

Examples of suitable FDA regulation food grade quality white oils that can be used in the present invention include MARCOL 52—naphthenic content 34%, MARCOL 82—naphthenic content 32%, MARCOL 172—naphthenic content 34%, PRIMOL 352 —naphthenic content 32%, and PLASTOL 352—naphthenic content 32%, all supplied by Exxon/Esso. Examples of suitable FDA regulation technical grade white oils that can be used in the present invention include BAYOL 52—naphthenic content 34% and PLASTOL 135—naphthenic content 36%, both supplied by Exxon/Esso. MARCOL, PRIMOL, PLASTOL and BAYOL are trade marks of Exxon Corporation. The naphthenic content is measured according to standard test method ASTM 2140.

The basestock may comprise 100% white oil, or may comprise a blend of white oil with one or more other types of oil, for example a mineral oil and/or a synthetic oil such as a polyalphaolefin or an ester such as a polyol ester or diester, and/or a hydrocracked-type basestock. If the basestock is a blend, the preferred proportion of white oil in the basestock is at least 30 wt %, more preferably between 30 and 60 wt %, most preferably between 30 and 40 wt. %. If the white oil is blended with a synthetic oil, the synthetic oil is preferably a polyalphaolefin, for example PAO 4 and/or PAO 6, where 4 and 6 are the respective viscosities of the PAOs in centistokes at 100° C. Where the basestock is a blend of white oil, mineral oil and synthetic oil, the preferred proportions are 30–80 wt. % white oil, 10–70 wt. % mineral oil and 5–50 wt. % synthetic oil.

The automotive lubricant may also contain other additives such as those typically contained in an engine oil, gear oil or automotive transmission fluid as appropriate. These include detergents, for example alkaline earth metal sulphonates, calcium salycilates, alkaline earth metal sulphurised phenates; ashless dispersants, for example polyisobutenesuccinimide, anti-wear/extreme pressure agents, for example zinc dialkyl (or diaryl or arylalkyl) dithiophosphate, and phosphorus/sulphurous or borated compounds; anti-corrosion agents, for example barium alkylnaphthalene sulphonates and mercaptobenzotriazole; viscosity index improvers, for example olefin copolymers, polyalphaolefinst polymethacrylates and styrene butadiene; pour point depressants, for example polyesters; anti-foam agents, for example those based on silicon; and friction modifiers, for example molybdenum compounds, ashless compounds and anti-squawk agents. For each additive, the amount included in the automotive lubricant varies depending upon the type of additive and the intended application of the lubricant. Generally, however, each additive is added in an amount up to 6 wt % based on the total weight of the lubricant except for the viscosity index improver(s) which may be added in an amount up to about 10 wt % (active ingredient). Some or all of the additives may be incorporated into the automotive lubricant by means of an addpack.

In general terms, the automotive lubricant according to the invention has a viscosity of 4 to 50 $mm^2/s$ at 100 ° C., and a viscosity index of 80 to 200. More specifically, where the lubricant is an engine oil, it preferably has a viscosity of 4 to 35 $mm^2/s$, more preferably 5 to 25 $mm^2/s$, at 100° C., and a viscosity index of 85 to 160, more preferably 95 to 150. Where the lubricant is a gear oil, it preferably has a viscosity of 5 to 50 $mm^2/s$, more preferably 8 to 25 $mm^2/s$, at 100° C., and a viscosity index of 80 to 180, more preferably 95 to 160. Where the lubricant is an automatic transmission fluid, it preferably has a viscosity of 4 to 10 $mm^2/s$, more preferably 5 to 8 $mm^2/s$, at 100° C., and a viscosity index of 100 to 200, more preferably 150 to 200.

It is important that the white oil contains an antioxidant additive. Surprisingly, it has been found that the white oil tested without the addition of an antioxidant is sensitive to oxidation and can have a lower performance than mineral oil. However, when an anti-oxidant is included in the white oil lubricant formulation the oxidation performance is superior to a comparable formulation based on mineral oil.

The antioxidant is selected from one or more of zinc dialkyl dithiophosphate, zinc diaryl dithiophosphate, zinc alkylaryl dithiophosphate, alkylated diphenylamine, hindered phenol, phosphosulphurised alkylphenol, sulphurised phenol, dimercapto dithiadiazole, and copper based antioxidants such as copper oleate and copper polyisobutylene succinic anhydride or a derivative thereof. The amount of antioxidant added to the lubricant is preferably from 0.05 to 3 wt %, more preferably from 0.1 to 2 wt %, based on the total weight of the lubricant, and most preferably from 0.2 to 1.0 wt %.

The white oil of the gear oil or automatic transmission fluid is preferably as described above, and may be blended with mineral oil or synthetic oil or both, to form a blended white oil basestock. If blended, the basestock preferably comprises at least 50 wt % white oil based on the weight of the basestock.

The present invention shall now be illustrated by the following Examples. The Examples include references to the accompanying drawings in which.

EXAMPLES

Example 1

White oils having the following properties were obtained by conventional solvent extraction and mild hydrogenation methods:

| | White Oil A | White Oil B | White Oil C |
|---|---|---|---|
| Naphthenic content (%) (ASTM D 2140) | 33.8 | 32.2 | 31.6 |
| Viscosity at 40° C. (cSt) (ASTM D 445) | 31.6 | 71.4 | 14.6 |
| Viscosity index (ASTM D 2270) | 108 | 98 | 107 |
| Pour point (° C.) (ASTM D 97) | −6 | −18 | −9 |

The white oils were formulated into various automotive lubricants as described in the following Examples. The oxidation stability of each lubricant was tested according to standard test GFC TO21A90. The oxidation stability was compared with equivalent lubricant formulations based on mineral oil, synthetic oils, and hydrocracked basestocks, as described in the following Examples.

Example 2

A super high performance diesel (SHPD) engine oil based on a mixture of white oils A and B specified in Example 1 above was formulated as follows:

| Component | wt % | |
|---|---|---|
| White oil A | 54.598 | |
| White oil B | 20.20 | |
| SHPD type addpack* | 14.70 | HITEC 865 from Ethyl Corp |
| VI improver | 10.50 | OCP from Exxon Chemical |
| Antifoam agent | 0.002 | Silicon type-DC-200/60000 from Dow Corning |

*Contains 8.3 wt % zinc dialkyl dithiophosphate ("ZDDP") antioxidant where the alkyl group is typically a $C_5$ to $C_8$ linear of branched alkyl group, for example a 2-ethylhexyl group. Thus the oil formulation contains 1.22 wt % ZDDP antioxidant.

Figure 1:
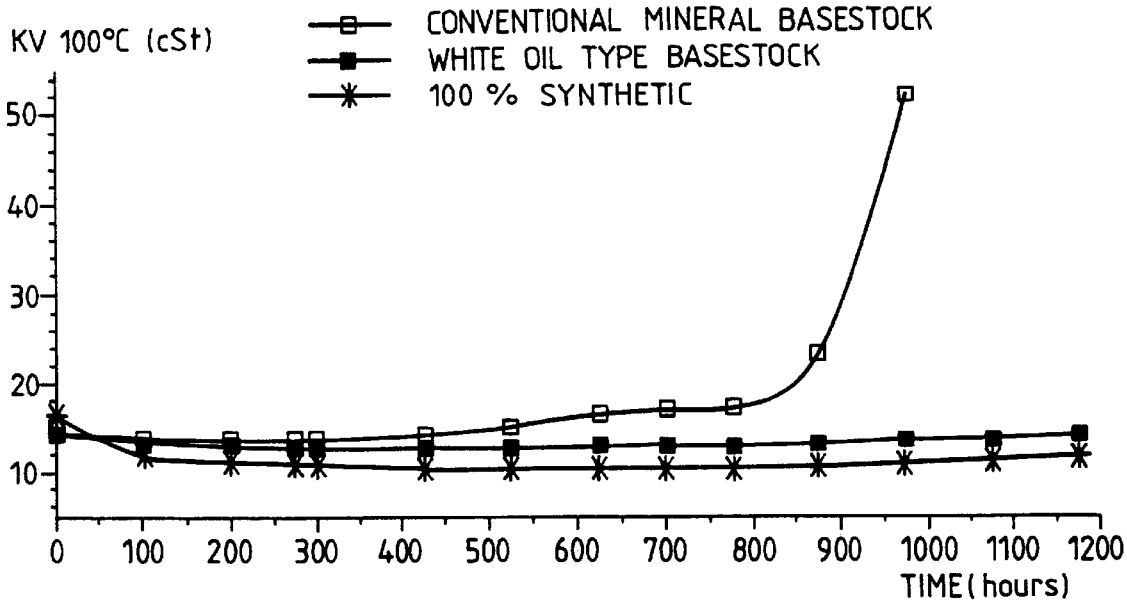
FIG. 1 is a graph showing the oxidation stabilities of super high performance diesel oils based on white oil, mineral oil and synthetic basestocks.
Figure 2:
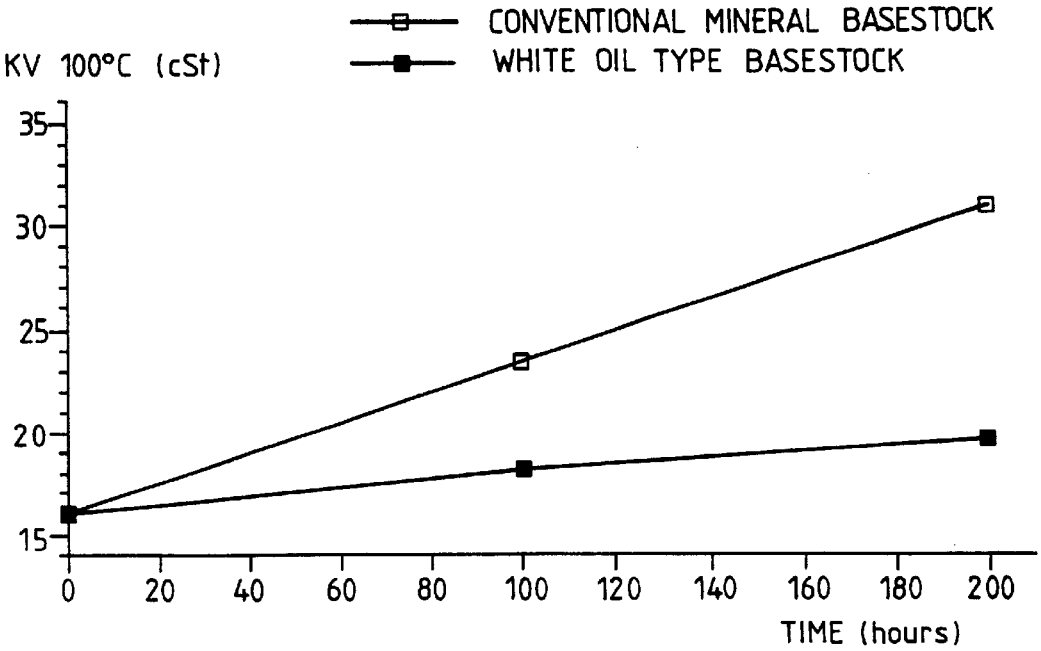
FIG. 2 is a graph showing the oxidation stabilities of automotive gear oils based on white oil and mineral oil basestocks.

For comparison, equivalent formulations were prepared replacing the white oils with the same amount of (a) conventional mineral oil, and (b) a PAO/ester synthetic oil. The oxidation stability of each of the three oils was measured by testing a 300 ml sample of oil at a temperature of 160° C. and an air flow of 10 1/hr. The results are given graphically in FIG. 1.

The results show that the SHPD oil based on a conventional mineral oil breaks down after 800 hours, whereas the equivalent oil based on white oil continues to operate satisfactorily after 1000 hours and has a similar performance to the synthetic based oil.

Example 3

An automotive gear oil based on white oil A specified in Example 1 above was formulated as follows:

| Component | Wt % | |
|---|---|---|
| White oil | 78.998 | |
| Antioxidant | 0.20 | phenolic |
| VI improver | 10.00 | polymethacrylate |
| EP additive | 0.50 | phosphite |
| Pour point depressant | 0.80 | polyacrylate |
| Gear oil addpack | 6.50 | Auglamol 99 from Lubrizol |
| Antifoam agent | 0.002 | DC 200/60000 from Dow Corning |
| Antisquawk addpack | 3.00 | LZ 6178A from Lubrizol |

For comparison, an equivalent gear oil was formulated replacing the white oil with the same amount of conventional mineral oil basestock. Their oxidation stabilities were measured by testing a 300 ml sample at a temperature of 150° C. and an air flow of 10 1/hr. The results are given graphically in FIG. 3.

The results show that the rate of viscosity increase is lower for the white oil based gear oil, and therefore this has a higher oxidation stability than the mineral based gear oil.

Example 4

An automatic transmission fluid (ATF) containing as basestock a blend of white oil, mineral oil and PAO synthetic oils, the white oil being white oil C specified in Example 1 above, was formulated as follows:

| Component | Wt % | |
|---|---|---|
| White oil C | 40.00 | |
| Mineral oil | 29.266 | |
| PAO 4 | 10.00 | |
| PAO 6 | 10.00 | |
| Antioxidant (phenolic) | 0.10 | HITEC 4782 available from Ethyl Corp (UK) |
| Antioxidant (amine) | 0.10 | IRGANOX L57 available from Ciba-Geigy |
| ATF addpack | 10.50 | 0S87256 from Lubrizol |
| Copper deactivator | 0.03 | |
| Antifoam agent | 0.004 | AKC 50000 from Wacker-Chemie |

The resulting ATF has a viscosity of 6.9 cSt at 100° C. (ASTM D 445) and a viscosity of 22500 cSt at −40° C. (DIN 51 562 part 1). The oxidation stability of the fluid was tested by exposing 500 ml of the fluid under heat (160° C.) to air flowing at a rate of 10 1/minute for 250 hours in the presence of an iron/copper catalyst (test DIN 51587). The test was repeated using a conventional mineral oil based ATF (ESSO ATF D-21065 —available from Esso AG). The exposed fluids were measured for increase in kinematic viscosity at 100° C. (KV 100) according to standard test DIN 51 562, and for total acid number (TAN) according to standard test ASTM 664. The results are given in Table 1.

TABLE 1

| | White oil-containing ATF Invention | Mineral oil ATF Comparative |
|---|---|---|
| Increase in KV100 | +1.5% | +4.5% |
| TAN | 1.9 mgKOH/g | 6 mgKOH/g |

The smaller the increase in KV100 and the smaller than TAN, the more stable is the ATF against oxidation. Thus the results show that the white-oil containing ATF according to the present invention has superior oxidation properties compared to the conventional mineral oil based ATF.

The friction characteristics of the two ATFs were also measured using a DKA friction testing machine operating at a speed of 3000/min, a cycle rate of 2/min, an energy density of 0.6 to 1.0 J/mm$^2$ and a temperature of 80 ° C. The results are given in Table 2.

TABLE 2

| | White oil-containing ATF | | | Mineral Oil ATF | | |
|---|---|---|---|---|---|---|
| Cycles | u1 | u2 | u3 | u1 | u2 | u3 |
| 10 | 0.134 | 0.127 | 0.169 | 0.136 | 0.132 | 0.169 |
| 1000 | 0.132 | 0.122 | 0.151 | 0.145 | 0.134 | 0.150 |
| 9000 | 0.127 | 0.112 | 0.127 | 0.128 | 0.110 | 0.126 |
| 22000 | 0.119 | 0.106 | 0.131 | 0.125 | 0.109 | 0.124 |
| 36000 | 0.119 | 0.111 | 0.132 | 0.125 | 0.111 | 0.126 |
| 47000 | 0.111 | 0.102 | 0.138 | 0.121 | 0.112 | 0.128 |
| 67000 | 0.114 | 0.102 | 0.139 | 0.124 | 0.116 | 0.134 |

The results show that the white oil-containing ATF has comparable, and in some instances, lower friction coefficients than the conventional mineral oil ATF.

What is claimed is:

1. An automotive lubricant comprising:

(a) a basestock of which at least 30 wt. % is a white oil having a naphthenic content of at least 25 wt. %; and (b) an antioxidant selected from one or more of zinc dialkyldithiophosphate, zinc diaryldithiophosphate, zinc alkylaryldithiophosphate, alkylated diphenylamine, hindered phenol, phosphosulphurised alkylphenol, sulphurised phenol, dimercaptodithiadiazole and copper-based antioxidant compounds;

with the proviso that the lubricant does not contain a tin-containing antioxidant or an organically substituted phosphite or diphosphite antioxidant.

2. An automotive lubricant according to claim 1 wherein the basestock is a blend of white oil and one or more of mineral oil, synthetic oil and hydrocracked-type basestock.

3. An automotive lubricant according to claim 2 wherein the synthetic oil is a polyalphaolefin.

4. An automotive lubricant according to claim 1 wherein the basestock is substantially 100% white oil.

5. An automotive lubricant according to claim 1 wherein the white oil has a naphthenic content of between 30 and 50 wt. %.

6. An automotive lubricant according to any preceding claim in which the lubricant is an engine oil, gear oil or automatic transmission fluid.

7. In engine oil, gear oil and automatic transmission lubricants comprising a basestock and one or more antioxidant additives other than tin-containing or organically substituted phosphate or diphosphate antioxidants, the improvement comprising:

using as the basestock at least 30 wt. % of a white oil having at least 25 wt. % naphthenic content.

8. The improvement of claim 7 wherein the basestock is a blend of white oil and one or more of mineral oil, synthetic oil and hydrocracked basestock.

* * * * *